US009433246B2

(12) United States Patent
Freeman et al.

(10) Patent No.: US 9,433,246 B2
(45) Date of Patent: Sep. 6, 2016

(54) EVAPORATIVE STRUCTURES, PARTICULARLY FOR BODY COOLING

(71) Applicant: QINETIQ LIMITED, Farnborough, Hampshire (GB)

(72) Inventors: Robert Anthony Freeman, Basingstoke (GB); Rajinder Singh, Sandhurst (GB)

(73) Assignee: QINETIQ LIMITED, Hampshire (GB)

( * ) Notice: Subject to any disclaimer, the term of this patent is extended or adjusted under 35 U.S.C. 154(b) by 0 days.

(21) Appl. No.: 14/884,352

(22) Filed: Oct. 15, 2015

(65) Prior Publication Data

US 2016/0029711 A1 Feb. 4, 2016

Related U.S. Application Data

(63) Continuation of application No. 13/641,221, filed as application No. PCT/GB2011/000604 on Apr. 19, 2011, now Pat. No. 9,188,398.

(30) Foreign Application Priority Data

Apr. 21, 2010 (GB) ..... 1006620.7

(51) Int. Cl.
*F28D 15/04* (2006.01)
*A41D 13/005* (2006.01)
(Continued)

(52) U.S. Cl.
CPC ..... *A41D 13/0056* (2013.01); *F28D 15/0241* (2013.01); *F28D 15/04* (2013.01); *F28F 13/003* (2013.01); *A41D 13/0053* (2013.01)

(58) Field of Classification Search
CPC ..... A41D 13/0056; A61F 2007/0065; A61F 2007/0063; A61F 7/02; A61F 2007/0234; A61F 2007/0257; A61F 2007/0258; A61F 2007/026
USPC ..... 62/259.3
See application file for complete search history.

(56) References Cited

U.S. PATENT DOCUMENTS 4,339,929 A 7/1982 Fitzpatrick et al.
5,263,336 A 11/1993 Kuramarohit
(Continued)

FOREIGN PATENT DOCUMENTS

EP 0 059 581 A2 9/1982
EP 0 076 079 A2 4/1983
(Continued)

OTHER PUBLICATIONS

Jul. 13, 2010 Search Report issued in British Patent Application No. 1006620.7.
(Continued)

*Primary Examiner* — Cassey D Bauer
(74) *Attorney, Agent, or Firm* — Oliff PLC

(57) ABSTRACT

A generally planar, conformable evaporative structure, particularly for incorporation in a garment or an item of personal protective equipment as part of a system to cool the wearer's body, includes an envelope of substantially impermeable, flexible material containing: a layer of flexible wick material disposed adjacent to a major face of the envelope and adapted to hold a working fluid in liquid phase for evaporation by heat conducted through the envelope; a layer of flexible, breathable fabric in parallel with the layer of wick material; and an array of flexible ribs such as open helical coils within the layer of breathable fabric adapted to maintain pathways for the flow of working fluid in vapor phase towards a condensation zone.

15 Claims, 5 Drawing Sheets

(51) Int. Cl.
*F28D 15/02* (2006.01)
*F28F 13/00* (2006.01)

(56) References Cited

U.S. PATENT DOCUMENTS

| | | | |
|---|---|---|---|
| 5,603,375 | A | 2/1997 | Salt |
| 6,349,412 | B1 | 2/2002 | Dean |
| 6,763,671 | B1 | 7/2004 | Klett et al. |
| 2007/0295494 | A1 | 12/2007 | Mayer et al. |
| 2010/0011491 | A1 | 1/2010 | Goldmann et al. |
| 2010/0031428 | A1 | 2/2010 | Paull |
| 2010/0319381 | A1 | 12/2010 | Hubler et al. |

FOREIGN PATENT DOCUMENTS

| | | | |
|---|---|---|---|
| EP | 0 306 531 | A1 | 3/1989 |
| GB | 2 093 981 | A | 9/1982 |
| WO | 92/13600 | A1 | 8/1992 |

OTHER PUBLICATIONS

May 31, 2012 Seach Report issued in International Application No. PCT/GB2011/000604.

May 31, 2012 Written Opinion of the International Searching Authority issued in International Application No. PCT/GB2011/000604.

EVAPORATIVE STRUCTURES, PARTICULARLY FOR BODY COOLING

The present application is a continuation application of U.S. application Ser. No. 13/641,221, filed Oct. 15, 2012, which is a national stage entry of PCT/GB11/00604, filed Apr. 19, 2011, which claims priority to GB 1006620.7, filed Apr. 21, 2010. The disclosures of each application described above are hereby incorporated by reference in their entireties.

The present invention relates to evaporative structures and more particularly, though not exclusively, to such structures for use in cooling the human body by means of the so-called heat pipe principle, that is to say the transfer of heat from a source to a sink by a continuous working fluid cycle which involves evaporation of the fluid at the source, transfer of the vapour to the sink, condensation of the fluid at the sink, and return of the liquid to the source.

The invention may be found to be particularly useful in reducing heat strain for those who are required to work in hot environmental conditions and/or wear personal protective equipment (PPE) such as body armour, respirators or fire-resistant, contamination-resistant or otherwise protective suits, vests, hoods or helmets, it being recognised that in general PPE adds thermal insulation to the wearer and is impermeable to water vapour meaning that it restricts loss of heat from the body by convection or evaporation of sweat, and therefore tends to increase the incidence of heat strain for the wearers of such equipment. In this respect heat strain is characterised by elevations in deep body core temperature, mean skin temperature, heart rate and sweat rate, and at high levels is known to cause thermal discomfort, impair performance and increase the risk of heat related illness.

The invention may, however, also be found more generally useful in the collection and distribution of heat for various applications requiring a conformable evaporative structure.

In GB2093981 there is proposed a conformable evaporative panel for use in human body cooling comprising a flexible reticulated, e.g. woven, structure including wicking and void continua, and an impermeable plastics film or laminate envelope surrounding the structure. The proposed working fluid is water, which is a good choice due to its high latent heat of evaporation and non-toxicity. However water has a low vapour pressure which means that a substantial vacuum level needs to be maintained within the envelope for useful evaporation to occur within the required temperature range for human body cooling. The need for evacuation of the envelope has the disadvantage though that there is a danger of the woven structure collapsing into its vapour flow voids and thereby preventing operation of the heat pipe cycle. The disposition of lengths of wicking in alternate voids within the woven structure as proposed in GB2093981 also limits the area of the panel over which efficient heat transfer into the working fluid held by the wicking can take place.

In one aspect the present invention aims to overcome the drawbacks of the above-mentioned prior art and accordingly resides in a generally planar, conformable evaporative structure comprising: an envelope comprising substantially impermeable, flexible material containing: a layer of flexible wick material disposed adjacent to a major face of said envelope, adapted to hold a working fluid in liquid phase for evaporation by heat conducted through said envelope; a layer of flexible, breathable fabric adjacent to said layer of wick material; and one or more flexible rib(s) within said layer of breathable fabric, adapted to maintain pathway(s) for the flow of working fluid in vapour phase towards a condensation zone.

By "generally planar" we mean that the structure is of a form having two major faces separated by a thickness which is small compared to the dimensions of those faces. It need not necessarily be flat, however, and in some embodiments may have a built-in curvature to more readily conform to a surface from which heat is to be extracted, such as part of the human body. In any event the flexibility of its constituent parts means that it is inherently conformable to a certain degree to surfaces which are not themselves flat.

The material of the envelope in a structure according to the invention is preferably a so-called barrier film comprising multiple layers of polymer (typically polyester, polypropylene, polyamide or polyethylene) with one or more intermediate layers of metal (typically aluminum) to confer resistance to gas or vapour migration through the film. Such polymer/metal laminates are typically in the range of only 75-150 μm thick and therefore provide little resistance to heat conduction through the film. The metal in such films is included either as a foil or a plasma of small platelets deposited on top of each other onto a polymer film substrate, and we have found the latter type to be superior to the foil type in terms of resistance to damage by creasing or other deformation of the film in use of the structure. Films of this nature are also available with the addition of a felted layer on one side and such may be useful particularly when the structure is to be used for human body cooling. That is to say by providing a felted barrier film on that face of the structure which is intended to be in contact with the body, with the felt layer outermost, the felt layer will tend to absorb sweat from the body and provide a better heat conductive path into the structure.

The wick material in a structure according to the invention may be any suitable available fibrous matting or other material capable of distributing the liquid working fluid by capillary forces within the respective layer, such as those known as hydrowicks used in garment manufacture and those used in spill kits. Preferably the layer of wick material extends over substantially the whole area of one of the major faces of the envelope to maximise heat transfer into the working fluid held by that layer.

The breathable fabric in a structure according to the invention is preferably a so-called spacer fabric. Such fabrics are synthetic fibre knitted or woven three-dimensional structures which typically comprise two faces of fabric that are held apart by a network of cross-stitched filaments. This layer includes voids through which in use vapour produced from the working fluid in the wicking layer can diffuse into the pathway(s) maintained by the rib(s). It also acts to support the envelope material and reduce the risk of its puncture or creasing particularly when a barrier film is employed as indicated above and when the structure is under vacuum.

The flexible rib(s) within the layer of breathable fabric in a structure according to the invention are useful, particularly when the structure needs to be under vacuum, in resisting collapse of the structure and ensuring that a sufficient vapour flow area remains available. They are preferably in the form of open-sided tubular rib(s), by which we mean that they are generally of tubular form but have openings through the respective tubular wall through which in use vapour can diffuse into the respective pathway inside each rib. Such ribs could therefore comprise lengths of plastics tubing with a multiplicity of holes formed through their walls. In a preferred embodiment however they comprise helical coils of metal or plastics in an open form so that a helical space exists between adjacent turns along the length of the rib.

The invention also resides in a cooling system comprising one or more evaporative structures as defined above and means defining one or more associated heat sinks for condensation of said working fluid in vapour phase.

The return of condensate from the heat sink to the wick material of the evaporative structure(s) in such a system may itself be accomplished by wicking. This may however be impractical, particularly when having to work against gravity, and there may instead be a pump provided for this purpose.

In one arrangement of such a system the heat sink(s) are separate from the or each evaporative structure and the system comprises conduit means for leading working fluid in vapour phase from the evaporative structure(s) towards the heat sink(s) and conduit means for returning working fluid in liquid phase to the evaporative structure(s). In another, a heat sink is integrated with the or each evaporative structure so that condensation takes place within the structure itself. In any event there may also be a heat exchanger in communication with the or each heat sink through which heat can be released into the environment.

The working fluid in such a system when used for human body cooling is preferably water and in such case the evaporative structure(s) will in use be maintained under vacuum. However in other embodiments there may be a range of other suitable working fluids including ammonia, azeotropic mixtures of water and alcohol, or hydrofluorocarbons.

The invention also resides in a garment, or an item of PPE, incorporating or adapted for use with a system as defined above, and supporting one or more said evaporative structures so as to be in heat transferring relationship with part of the human body when worn, e.g. torso or head.

The invention will now be more particularly described, by way of example, with reference to the accompanying drawings, in which.

Figure 1:
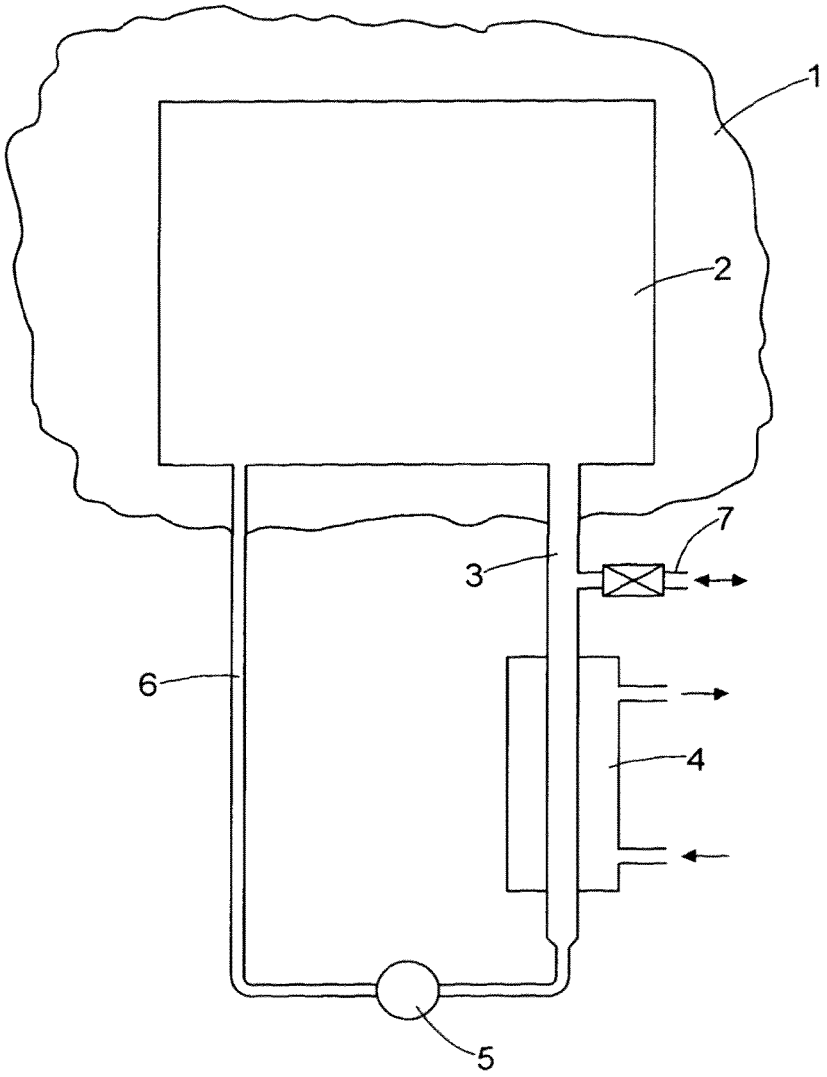
FIG. 1 illustrates schematically the principle of operation of a human body cooling system according to the invention.

FIG. 1 illustrates the principle of operation of the invention to cool a heat source 1 which in the present embodiment is the human body. A generally planar and conformable evaporator patch 2 is supported in a garment so as to be held with one of the major faces of the patch in contact with part of the body and generally conform to its contour. The garment in question (not shown) may be worn under or incorporated in an item of PPE, or worn independently of PPE when working in a hot environment not posing other threats. The patch holds a liquid working fluid in wick material which absorbs heat from the body by conduction through the envelope of the patch and consequently vaporises. The vapour flows under the generated pressure through a pipe 3 to an associated heat sink 4 in the garment. In this embodiment the heat sink comprises a jacket surrounding the pipe 3 through which cooling water is circulated via pipes from/to a refrigeration unit, evaporative or other form of heat exchanger (not shown) supported on the outside of the garment which can provide a negative temperature gradient to the environment into which heat can be released. The vapour is consequently condensed by the heat sink and the condensate is returned by a small pump 5 through a pipe 6 to the patch 2. In use the evaporation/condensation cycle in patch 2 and heat sink 4 operates on a continuous basis whenever the body 1 is at the temperature to vaporise the working fluid, to transfer heat from the body 1 to the sink 4 (and thence ultimately to the environment) and hence the illustrated system can be regarded as a developed form of heat pipe.

The working fluid in the present embodiment is water. In order to vaporise efficiently within the temperature range required for human body cooling, therefore, the interior of the system must be evacuated, typically to around ⅓ atmosphere at which water will boil at around 35° C. For this purpose the pipe 3 is equipped with a valved tee 7 through which the patch 2 can initially be charged with water and the system then evacuated by connection of a vacuum pump.

In practice the patch 2 may be one of several such patches applied at various positions around the body and connected with a common or individual heat sink(s) 4.

Figure 2A:
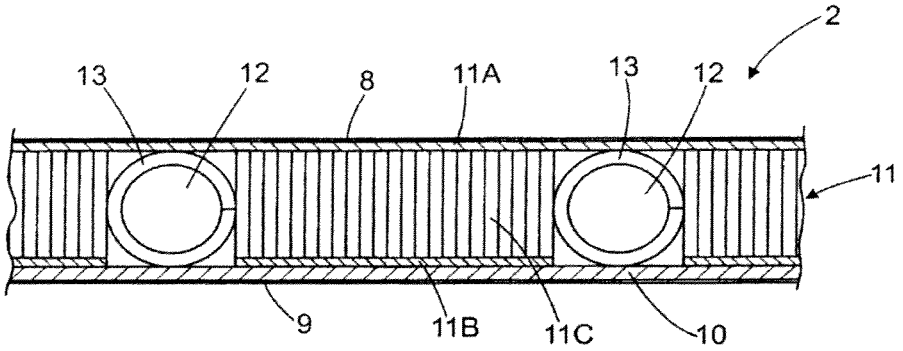
FIGS. 2A and 2B show a schematic cross-section through the thickness of part of an evaporator patch according to the invention used in the system of FIG. 1, prior to evacuation.

Description will now be directed to the structure of the evaporator patch 2. Referring to FIG. 2A it has an envelope formed from two flexible sheets of barrier film 8, 9, typically an aluminised polyethylene/polypropylene film, extending over respective major faces of the patch and the edges of which are heat-sealed together when the construction of the remainder of the patch is complete. Within this envelope there is a layer of flexible wick material 10 lying adjacent to the sheet 9 which defines the face of the patch which is held against the body in use of the associated garment. In use this wicking layer 10 holds the liquid water for evaporation by absorption of heat conducted through the sheet 9 over substantially the whole of its area. Although not illustrated as such, the sheet 9 may also have a felted layer on its outer side for the absorption of sweat.

Between the wick material 10 and the sheet 8 there is a layer of flexible spacer fabric 11, comprising a knitted three-dimensional breathable structure with two faces of fabric 11A and 11B held apart by a network of cross-stitched filaments 11C. The knitting of this layer is also controlled to produce a network of channels 12 in the structure in which are inserted flexible ribs in the form of lengths of open helical metal or plastics coils 13. The arrangement of these channels and coils in the spacer fabric is more fully shown in FIG. 3, comprising a plurality of parallel rows extending across the width of the patch and a single coil along each of the upper and lower edges of the patch, as viewed in FIG. 3, in channels which intersect with the ends of the channels in each row. The tendency of the spacer fabric 11 when the patch is evacuated is to collapse inwards. However the presence of the coils 13 ensures that the fabric will not collapse into the channels 12 although there will be some compression of the structure between the coil rows giving the structure a more undulating profile than that indicated in FIG. 2A which shows the structure pre-evacuation. In use of the patch the vapour produced from the wicking layer 10 diffuses into the small voids within the spacer fabric 11 and thence through the gaps between adjacent turns of the coils 13 into the channels 12 which provide pathways for the flow of vapour into the pipe 3 which communicates with the channel along the lower edge of the patch. In this respect although partially collapsed between the coil rows the spacer fabric 11 provides sufficient flow area for vapour to pass to the channels 12 held open by the coils 13, but would not itself provide sufficient flow area from the structure in the absence of the coils. The spacer fabric also supports the barrier film sheets 8 and 9 and reduces the risk of their puncture or creasing under vacuum.

Figure 2B:
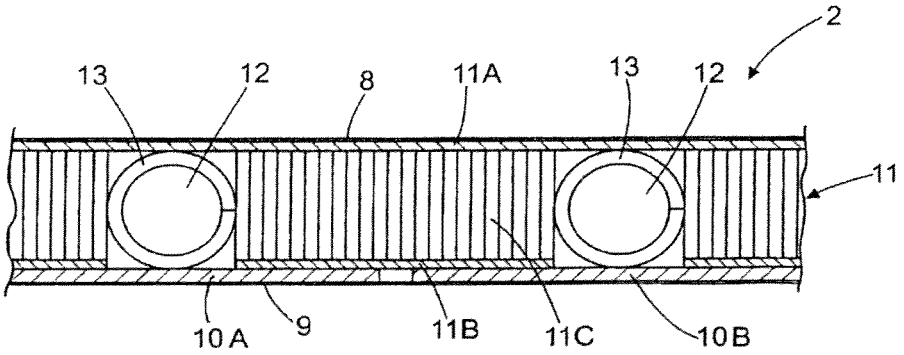

FIG. 2B shows an evaporator patch 2 similar to that of FIG. 2A, except that the layer of flexible wick material has been arranged as a plurality of non-contiguous sections. Two such sections are shown, 10A and 10B, with a space therebetween.

Both the pipes 3 and 6 enter the patch 2 through a fitment 14 sealed between the barrier film sheets.

Figure 3:
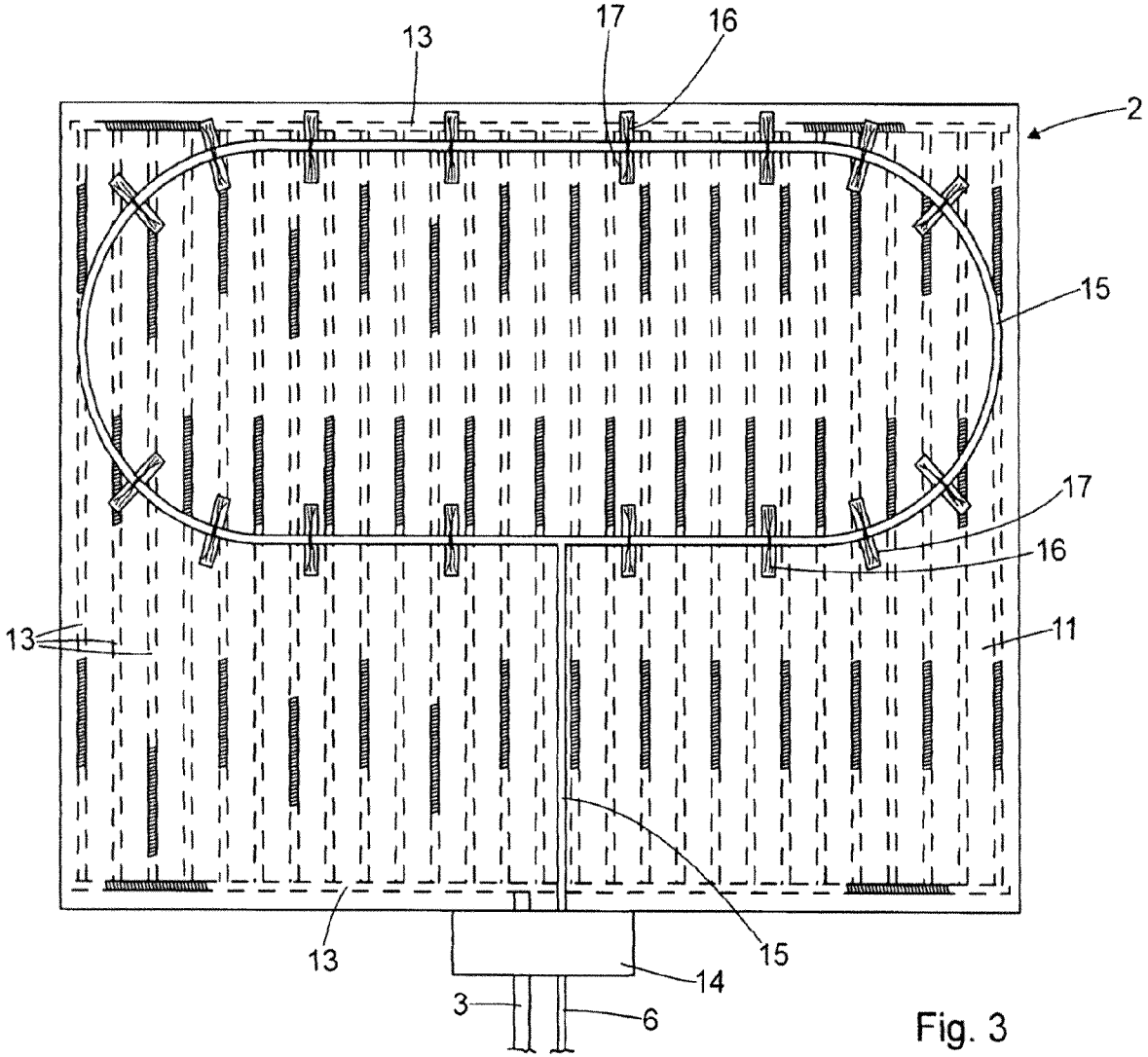
FIG. 3 illustrates the interior of the evaporator patch of FIGS. 1 and 2 viewed from the contact face and with its envelope and wicking layer removed.
Figure 4:
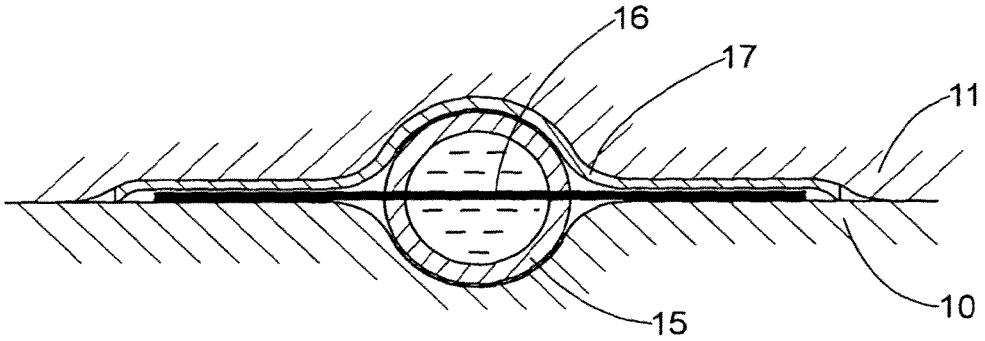
FIG. 4 is a schematic cross-section through a condensate delivery point in the evaporator patch of FIGS. 1 to 3.

FIG. 3 also shows the arrangement for returning condensate to the wick material 10 (that material itself not shown in that Figure). That is to say the pipe 6 from the pump 5 joins within the patch 2 with flexible plastics tubing 15 which is disposed between the layers of wick material 10 and spacer fabric 11 and is formed into a loop in the upper half of the patch (it being intended that in use the patch will be held in the generally vertical orientation indicated in FIG. 3). Referring also to FIG. 4, at various positions along this loop the tubing is formed with pairs of opposed pin holes through the tube wall and lengths of twisted yarn wick fibre 16 are threaded though these holes and across the interior of the tubing. Strips of wick material 17 are also inserted across the outside of tubing and fibres 16 on the opposite side to the wick material 10 at these positions. Condensate from the tubing 15 is therefore delivered into the wick material 10 through the wicks 16, the upper run of the tubing loop serving the upper half of the wicking layer 10 and the lower run of the tubing loop serving the lower half of the wicking layer 10 as in the illustrated orientation gravity will assist the downward progression of condensate from the tubing through that material. The wick material may in fact be segmented into non-contiguous upper and lower sections to prevent the loss of condensate from the upper section to the lower section by gravity. Each of those sections may also be segmented into a number of non-contiguous widthwise sections. This may be useful in the event that different regions experience different rates of heating in use of the structure and consequently different evaporation rates. In such a case the hotter regions of wick material would tend to draw condensate from the neighbouring cooler regions but this is prevented by segmenting that material and instead they will draw at an increased rate from the tubing 15 which leads to a more efficient distribution of condensate within the wicking.

The presence of wicks 16 in the tubing holes is preferred to using those holes alone to distribute the condensate from the tubing 15 into the material 10. Firstly their presence ensures that the holes do not close up under the vacuum within the patch 2. Secondly they provide a useful method of balancing the water delivery process, simply by selecting the number of fibres used at each position. Similarly they avoid the risk of the patch becoming flooded with condensate which could otherwise flow unchecked though the open holes even under conditions when there is little or no demand for condensate from the material 10. By sandwiching the ends of the wicks 16 between the material 10 and the extra wicking strips 17 it is also ensured that the dispensed water droplets will not bypass the material 10 and simply fall into the spacer fabric 11 potentially leading to dry areas in the wick layer.

Figure 5:
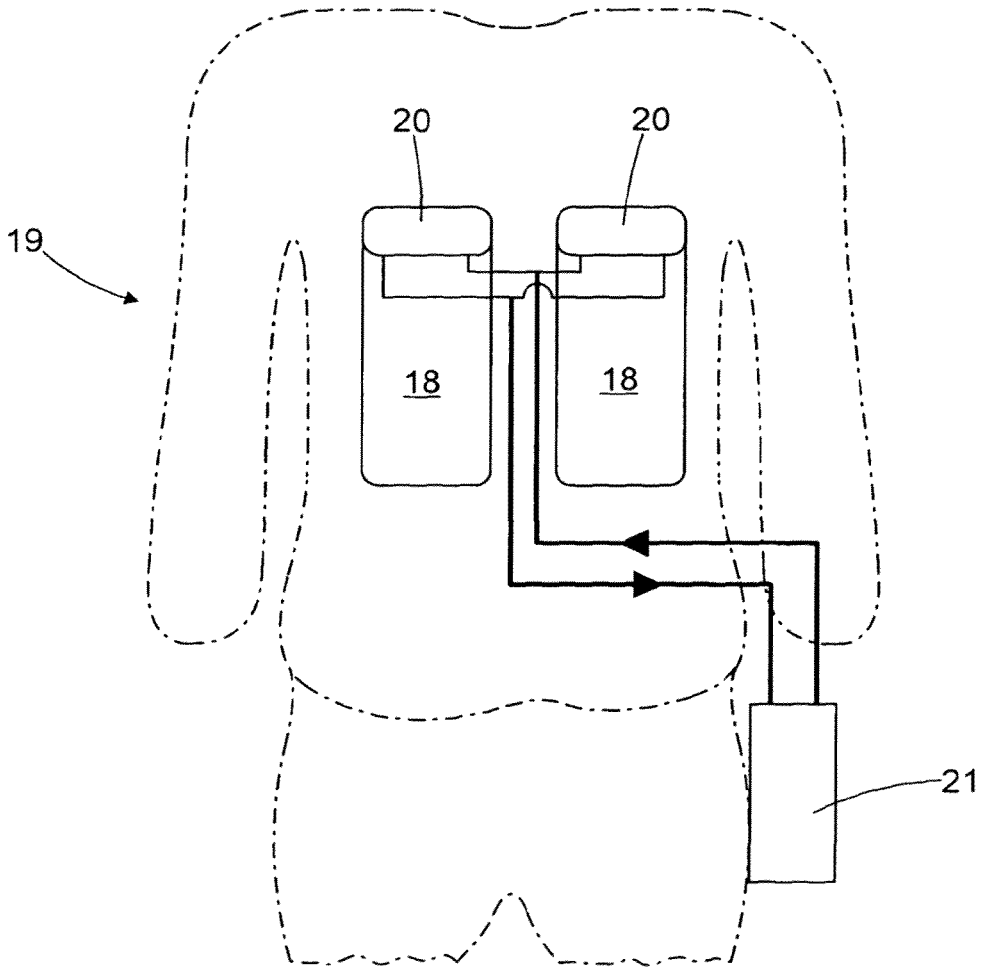
FIG. 5 is a schematic diagram of another embodiment of a human body cooling system according to the invention.

Turning to FIG. 5, this illustrates schematically another embodiment of a human body cooling system according to the invention.

In FIG. 5 two evaporator patches 18 are supported in the torso region inside a vest (not shown) worn under a protective suit 19. Although not shown in detail in this Figure each patch 18 is generally of similar construction to the patch shown in section in FIG. 2, comprising an envelope of barrier film containing layers of wick material and spacer fabric with a series of channels in the spacer fabric reinforced with open coils to lead vapour produced by evaporation of working fluid (water) in the wicking layer towards a condensation zone which in this case is within the upper part of the envelope of the respective patch itself. More particularly a heat sink 20 is integrated with each patch 18 in the form of a chamber formed on the outside surface of the envelope for the circulation of cooling water supplied from and returned to a heat exchanger 21 on the outside of the suit 19, via suitable pipework. The upper part of each patch envelope, on the face of the patch opposite to the contact face with the wearer's body, therefore provides a cooled surface for the condensation of vapour inside the patch. In this region of each patch there will be extra wicking for the return of condensate to the main wicking layer, this extra wicking itself being perforated to join with the channels in the spacer fabric in leading vapour to the cooled surface.

The invention claimed is:

1. A generally planar, conformable evaporative structure comprising:

an envelope comprising substantially impermeable, flexible material containing:

a layer of flexible wick material disposed adjacent to a major face of said envelope, adapted to hold a working fluid in liquid phase for evaporation by heat conducted through said envelope;

a layer of flexible, breathable fabric adjacent to said layer of wick material;

one or more flexible rib(s) within said layer of breathable fabric and in direct contact with said layer of wick material, adapted to maintain pathway(s) for the flow of working fluid in vapour phase towards a condensation zone; and one or more associated heat sinks for condensation of said working fluid in vapour phase;

wherein one of the one or more associated heat sinks is integrated with the or each said structure so that condensation takes place within the respective said structure, and wherein the structure further comprises a heat exchanger in communication with the or each heat sink through which heat can be released into the environment.

2. A structure according to claim 1 wherein said envelope comprises metallised polymer barrier film.

3. A structure according to claim 1 wherein said envelope carries an absorbent layer over the exterior of said major face thereof.

4. A structure according to claim 1 wherein said layer of wick material extends over substantially the whole area of said major face of said envelope.

5. A structure according to claim 1 wherein said layer of wick material is comprised of a plurality of non-contiguous sections.

6. A structure according to claim 1 wherein said breathable fabric is a knitted or woven spacer fabric.

7. A structure according to claim 6 wherein said spacer fabric is formed with one or more channel(s) within which said rib(s) are received.

8. A structure according to claim 1 wherein the or each said rib is of an open-sided tubular form.

9. A structure according to claim 8 wherein the or each said rib comprises an open helical coil.

10. A structure according to claim 1 comprising means for delivering working fluid in liquid phase to said wick material comprising a loop of apertured tubing interposed between said layers of wick material and breathable fabric.

11. A structure according to claim 1 comprising means for delivering working fluid in liquid phase to said wick material comprising apertured tubing with wicks extending through said apertures from the interior of the tubing towards said material.

12. A structure according to claim 1 wherein said working fluid is water.

13. A structure according to claim 1 maintained under vacuum.

14. A system according to claim 1 wherein the heat sink(s) are separate from the or each said structure and comprising at least one conduit for leading working fluid in vapour phase from said structure(s) towards the heat sink(s) and at least one conduit for returning working fluid in liquid phase to said structure(s).

15. A garment, or an item of personal protective equipment, incorporating or adapted for use with a system according to claim 1, and supporting one or more said evaporative structures so as to be in heat transferring relationship with part of the human body when worn.

* * * * *